US005134260A

United States Patent [19]

Piehler et al.

[11] Patent Number: 5,134,260

[45] Date of Patent: Jul. 28, 1992

[54] METHOD AND APPARATUS FOR INDUCTIVELY HEATING POWDERS OR POWDER COMPACTS FOR CONSOLIDATION

[75] Inventors: Henry R. Piehler; John M. Richter, both of Pittsburgh; Michael Kuhni, Acme, all of Pa.

[73] Assignee: Carnegie-Mellon University, Pittsburgh, Pa.

[21] Appl. No.: 776,898

[22] Filed: Oct. 16, 1991

Related U.S. Application Data

[63] Continuation of Ser. No. 544,745, Jun. 27, 1990, abandoned.

[51] Int. Cl.[5] ..... H05B 6/10

[52] U.S. Cl. ..... 219/10.41; 75/10.14; 419/49; 419/52; 219/7.5

[58] Field of Search ..... 219/10.73, 7.5, 10.41, 219/10.43, 10.75; 75/10.14, 10.15; 419/49, 52, 48; 264/25, 26, 27

[56] References Cited

U.S. PATENT DOCUMENTS

| | | | |
|---|---|---|---|
| 2,393,130 | 1/1946 | Toulmin, Jr. | 219/7.5 |
| 2,431,095 | 11/1947 | Tucker | 219/7.5 |
| 2,437,127 | 3/1948 | Richardson | 219/7.5 |
| 3,248,215 | 4/1966 | Bonis et al. | 219/7.5 |
| 3,413,392 | 11/1968 | Meadows | 219/10.73 |
| 3,656,946 | 4/1972 | Inque et al. | 219/117.1 |
| 3,679,807 | 7/1972 | Carcey | 219/10.491 |
| 3,779,747 | 12/1973 | Conta | 219/10.41 |
| 4,856,311 | 8/1989 | Conaway | 219/7.5 |

*Primary Examiner*—Philip M. Leung
*Attorney, Agent, or Firm*—Ansel M. Schwartz

[57] ABSTRACT

An apparatus for heating powders or powder compacts for consolidation in a pressure vessel having a chamber. There is a device for directly induction heating the powder or powder compact. Additionally, the apparatus is comprised of a device for compacting a powder or powder compact. The device for directly induction heating the powder essentially provides uniform heating to the powder while the compacting device compacts the powder or powder compact in the chamber of the pressure vessel. A method for consolidation of powders or powder compacts which has the steps of heating directly by induction the powder or powder compact, and applying an isostatic stress to the powder or powder compact.

11 Claims, 1 Drawing Sheet

METHOD AND APPARATUS FOR INDUCTIVELY HEATING POWDERS OR POWDER COMPACTS FOR CONSOLIDATION

This is a continuation of copending application Ser. No. 07/544,745 filed on Jun. 27, 1990 now abandoned.

FIELD OF THE INVENTION

The present invention is related to the consolidation of powders or powder compacts. More specifically, the present invention is related to the consolidation of powders or powder compacts using induction heating.

BACKGROUND OF THE INVENTION

The theory [Kaysser, W. A., "Present State of Modeling of Hot Isostatic Pressing, " Second International Conference on Hot Isostatic Pressing—Theories and Applications, Gaithersburg, Md., Jun. 7-9, 1989] and technology [Fujikawa, T. and N. Kawai, "Recent Trends in HIP Process in Japan," Second International Conference on Hot Isostatic Pressing—Theories and Applications, Gaithersburg, Md., Jun. 7-9, 1989] of hot isostatic pressing (HIPing) have recently been reviewed at the Second International Conference on Hot Isostatic Pressing—Theories and Applications. Several modifications to the basic HIPing process for consolidation of particulates and composites have also been recently explored. Two such modifications involve altering the state of stress and strain during compaction. The first of these is sinter forging [Raj, R., "Enhancement of Strength through Sinter Forging, " *J. Am. Ceram. Soc.*, 70 [7], pp. 514–520, 1987], which has been used to increase the fracture resistance of alumina; the second is hot triaxial compaction (HTC) [Piehler, H. R. and D. M. Watkins, "Hot Triaxial Compaction: Apparatus Description and Initial Experimental Results, " Second International Conference on Hot Isostatic Pressing—Theories and Applications, Gaithersburg, Md., Jun. 7-9, 1989], which has been used by Piehler and Watkins to enhance the densification of Ti-6A1-4V spherical powder compacts.

An essential problem in hot isostatic pressing (HIPing) of metallic powders or powder compacts is the rapid and uniform heating of these powders or powder compacts to a required temperature. Recent work in microwave sintering of ceramics [Sutton, W. H. , "Microwave Processing of Ceramic Materials," *Ceramic Bulletin*, 68 [2], pp. 376–386, 1989] suggests that a method of heating the specimen from within would be highly desirable. Radio-frequency induction heating is a well established method of heating all types of metals and alloys for surface hardening, welding [Zinn, S. and S. L. Semiatin, *Elements of Induction Heating: Design, Control, and Applications*, ASM International, Metals Park, Ohio, 1988], etc. To date, no one has solved all of the problems associated with the application of radio-frequency induction heating technology to the sinter forging, HIPing, or HTCing processes. The successful implementation of R.F. induction heating to these processes could yield results superior to those achievable using radiative heating for the following reasons:

1. More rapid heating of powder compacts;
2. More uniform heating throughout the entire volume of the compact;
3. Enhanced densification of the compacts resulting from reduced spheroidization prior to consolidation;

4. A reduction in the total heat required for the process, allowing for faster production rates; and
5. The potential for producing consolidated compacts which cannot be fabricated using current heating techniques.

SUMMARY OF THE INVENTION

The present invention pertains to an apparatus for heating powders or powder compacts for consolidation. The apparatus comprises a pressure vessel having a chamber. There is means for directly induction heating the powder or powder compact. Additionally, the apparatus is comprised of means for consolidating a powder or powder compact. The means for directly induction heating the powder or powder compact essentially provides uniform heating to the powder while the compacting means consolidates the powder or powder compact in the chamber of the pressure vessel.

A method for consolidation of powders or powder compacts which has the steps of heating directly by induction the powder or powder compact, and applying an isostatic stress to the powder or powder compact.

BRIEF DESCRIPTION OF THE DRAWINGS

In the accompanying, drawings, the preferred embodiments of the invention and preferred methods of practicing the invention are illustrated in which.

DESCRIPTION OF THE PREFERRED EMBODIMENT

Figure 1:
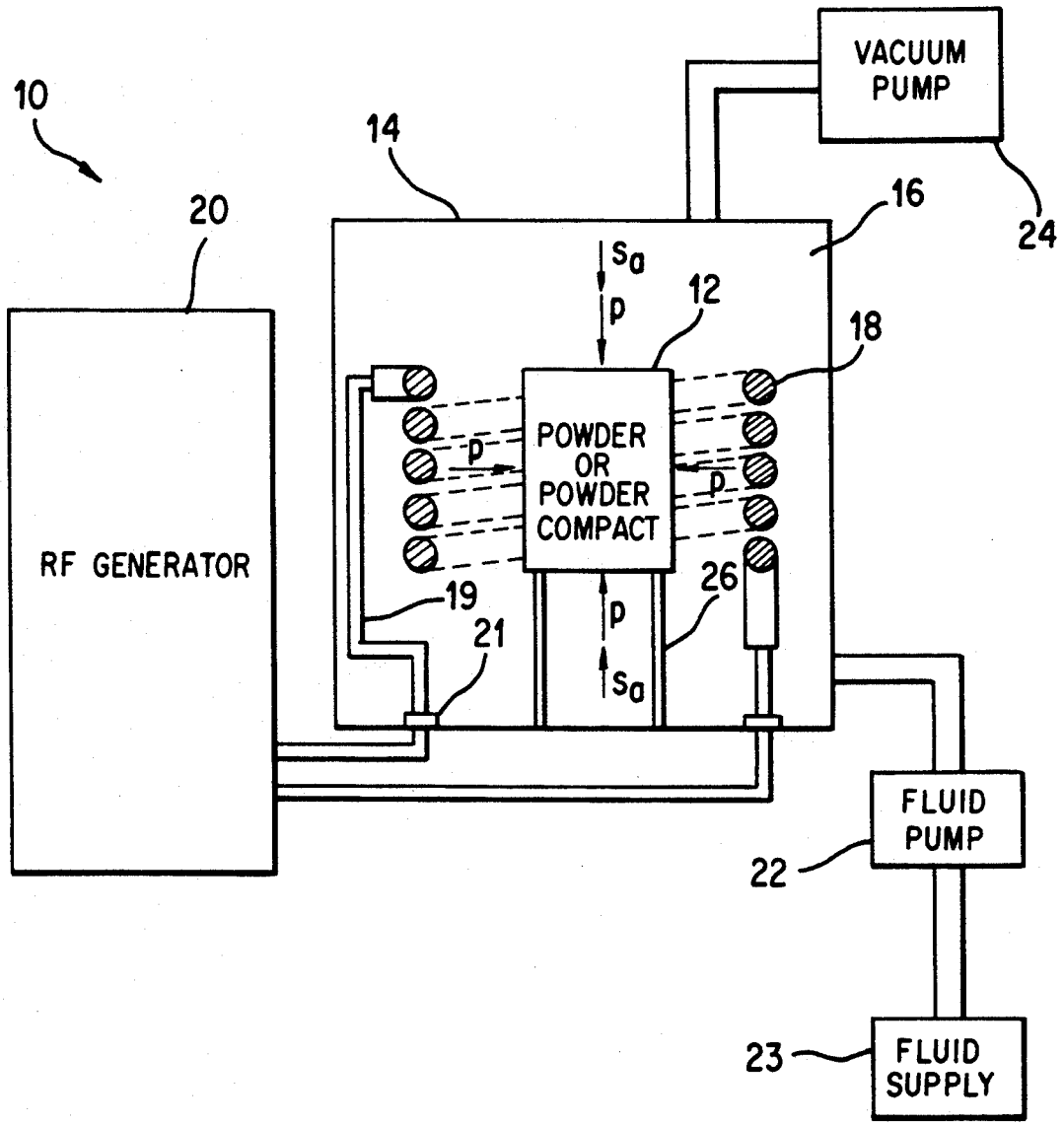
FIG. 1 is a schematic representation of an apparatus for heating powders or compacts for consolidation.

Referring to FIG. 1, there is disclosed an apparatus 10 for heating powders or powder compacts 12 for compaction. The powders 12 or powder 12 compacts can be metals, ceramics or composites. The apparatus 10 is comprised of a pressure vessel 14 having a chamber 16. The apparatus 10 is also comprised of means for directly induction heating the powder 12 or powder 12 compact. Additionally, the apparatus 10 is comprised of means for compacting the powder 12 or powder 12 compact. It should be noted that there are no cooling feedthroughs, such as water cooling pipes, penetrating the vessel 14.

Preferably, the induction heating means includes induction coils 18 disposed in the chamber 16. The induction coils 18 are preferably solid and made of tungsten plated with platinum. The induction heating means preferably also includes an RF generator 20 electrically connected to the induction coils 18 by means of gold plated copper wires 19 which pass through a feedthrough such as a nylon seal 21 in order to provide induction heating to the powder 12 or powder 12 compact. Preferably, the RF generator 20 is a variable frequency RF generator 20 that operates between 100 KHZ and 10 MGZ at a power level between 500 watts and 3 kilowatts, although it could be a single frequency RF generator 20. Thermocouples are typically used to sample temperature and are preferably disposed in a location in the chamber 16 that contacts the powder 12 or powder 12 compact.

The compacting means can include means for applying a shear stress to the powder 12 or powder 12 compact, or means for applying an isostatic stress to the powder 12 or powder 12 compact, or both. The means for applying an isostatic stress to the powder 12 or powder 12 compact can include a fluid supply 20 of, for instance, argon gas, fluidically connected to a fluid pump 22 which pumps fluid from the fluid supply 23 into the chamber 16 of the vacuum vessel 14 to a desired pressure, preferably above 5 KSI, to provide the isostatic stress. Depending on the method followed for compaction of the powder 12 or powder 12 compact, there can also be a vacuum pump 24 fluidically connected to the chamber 16 of the pressure vessel 14 to first evacuate the chamber 16 before the fluid pump 22 is activated. This provides for the voiding of the interstices in the powder 12 or powder 12 compact so when further compaction occurs, essentially no fluid is trapped within the powder 12 or powder 12 compact.

Typically, in sinter forging, the vessel 14 is first evacuated and then an axial force $S_a$ is applied to the powder 12 or powder 12 compact with a reducing, oxidized or inert gas possibly present. In HIPing, pressure P is provided to the chamber 16, and in triaxial compaction, both pressure P and an —axial force $S_a$ are applied to the powder 12 or powder 12 compact. The temperature present in the chamber 16 is a matter of choice dependent on the material and intended result.

If means for applying a shear stress to the powder 12 or powder 12 compact is used, with the means for applying an isostatic stress present or not, then the powder 12 or powder 12 compact (in the form of a compact) can be placed on a ram, see Piehler et al, supra, for a full description of a method and apparatus for compacting a powder 12 or powder 12 compact with means for applying a shear stress and means for applying an isostatic stress to a powder 12 or powder 12 compact, but with radiative heating, not induction heating. The ram serves not only to support the powder 12 or powder 12 compact in place, but also to provide an axial force to the powder 12 or powder 12 compact to create a shear stress therein. If only means for applying an isostatic pressure is present, then a stand 26 is disposed in the chamber 16 to support the powder 12 or powder 12 compact while an isostatic stress is applied to the powder 12 or powder 12 compact.

In the operation of the preferred embodiment, a variable frequency RF generator 20 is electrically connected with gold plated copper wires 19 to induction coils 18 made out of solid tungsten and plated with platinum. The copper wire 19 penetrates the vacuum vessel 14, at the bottom of the vessel 14 through nylon seals 21, and then extends to the coils 18. The solid tungsten coil 18 is approximately 3/8 of an inch in diameter. The coils 18 essentially form a cylinder surrounding the powder 12 or powder 12 compact that is to be further compacted.

Commercial purity titanium powder 12 or powder 12 compact is placed in the chamber 16 such that the induction coils 18 are positioned about it. The vessel 14 is then filled and pressurized to approximately 14.5 KSI. While pressurization is occurring, the RF generator 20 causes the induction coils 18 to heat the powder 12 or powder 12 compact to approximately 1650° F. A thermocouple continually samples the temperature of the powder 12 or powder 12 compact. This pressure and temperature is maintained for approximately 30 minutes after which time the temperature and pressure are allowed to return to room temperature. The powder 12 or powder 12 compact is then removed from the vessel 14.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for heating powders or powder compacts for consolidation comprising:

a presure vessel having a chamber, said powder or compact disposed in said chamber and essentially isolated therein such that fluidic pressure can act on a majority of the surface area of the powder or compact; p1 means for directly induction heating the powder or compact, said heating means disposed in said chamber between said powder or compact and said vessel, said heating means requiring no independent cooling; and means for compacting powder or powder compact, said compacting means in communication with said chamber.

2. An apparatus as described in Claim 1 wherein the induction heating means includes induction coils disposed in the chamber, and an RF generator electrically connected to the induction coils such that induction heating is provided to the powder or powder compact.

3. An apparatus as described in claim 2 wherein the compacting means includes means for applying a shear stress to the powder or powder compact.

4. An apparatus as described in claim 3 wherein the compacting means includes means for applying an isostatic stress to the powder or powder compact.

5. An apparatus as described in claim 4 wherein the RF generator includes a variable frequency RF generator.

6. An apparatus as described in claim 5 wherein the isostatic stress is in excess of 5 KSI.

7. An apparatus as described in claim 2 wherein the compacting means includes means for applying an isostatic stress to the powder or powder compact.

8. An apparatus as described in claim 7 wherein the compacting means includes a stand disposed in the chamber to support the powder or powder compact therein.

9. An apparatus as described in claim 1 wherein the apparatus has no cooling feedthroughs.

10. A method for heating powders or powder compacts for consolidation comprising the steps of:

disposing the powder or powder compact within a pressure vessel such that it is essentially isolated therein and fluidic pressure can act on a majority of the surface area of the powder or compact;

heating the powder or powder compact directly by induction heating means which requires no cooling and which is disposed within the pressure vessel between the vessel and the powder or powder compact; and pressurizing the vessel in excess of 5 KSI such that the powder or powder compact is isostatically stressed.

11. A method as described in claim 10 wherein after the heating step there is the step of applying a shear stress to the powder or powder compact.

* * * * *

UNITED STATES PATENT AND TRADEMARK OFFICE

CERTIFICATE OF CORRECTION

PATENT NO. : 5,134,260

DATED : July 28, 1992

INVENTOR(S) : Henry R. Piehler, John M. Richter, Michael Kuhni

It is certified that error appears in the above—identified patent and that said Letters Patent is hereby corrected as shown below:

Column 2, line 29, before "compacts" insert -- powder -- .

Column 3, line 19, delete -- ____ -- .

Column 3, line 64, after "temperature" insert -- and pressure -- .

Column 4, line 12, before "compact" insert -- powder -- .

Column 4, line 15, before "compact" insert -- powder -- .

Column 4, line 15, delete "pl".

Column 4, line 16, before "compact" insert -- powder -- .

Column 4, line 18, before "compact" insert -- powder -- .

Column 4, line 20, after "compacting" insert -- the -- .

Column 4, line 53, before "compact" insert -- powder -- .

Signed and Sealed this

Twelfth Day of October, 1993

*Attest:*

*Attesting Officer*

Bruce Lehman

BRUCE LEHMAN

*Commissioner of Patents and Trademarks*